United States Patent [19]

Schaenzer

[11] 4,331,063

[45] May 25, 1982

[54] CARTRIDGE RELOADING PRESS

[76] Inventor: Gordon N. Schaenzer, 11737 N. Solar Ave. 77W, Mequon, Wis. 53092

[21] Appl. No.: 155,072

[22] Filed: Jun. 2, 1980

[51] Int. Cl.[3] ..... F42B 33/02

[52] U.S. Cl. ..... 86/36; 86/23; 86/26; 86/31; 86/41; 86/44; 86/43

[58] Field of Search ..... 86/23, 25, 26, 31, 32, 86/36, 39, 41, 43–46

[56] References Cited

U.S. PATENT DOCUMENTS

| | | | |
|---|---|---|---|
| 2,800,830 | 7/1957 | Gerstenberger | 86/23 |
| 2,961,915 | 11/1960 | Saio | 86/36 X |
| 3,001,436 | 9/1961 | Deitemeyer | 86/25 |
| 3,057,247 | 10/1962 | Behrens | 86/25 |
| 3,073,208 | 1/1963 | Agnese | 86/31 X |
| 3,105,408 | 10/1963 | Bachhuber | 86/25 |
| 3,110,214 | 11/1963 | Benda et al. | 86/36 |
| 3,113,483 | 12/1963 | Puth | 86/23 |
| 3,240,103 | 3/1966 | Lamont | 86/45 X |
| 3,240,104 | 3/1966 | Bachhuber | 86/39 |
| 3,242,790 | 3/1966 | Bachhuber | 86/25 X |
| 3,336,829 | 8/1967 | Lee | 86/23 |
| 3,345,903 | 10/1967 | Purdie | 86/23 |
| 3,450,000 | 6/1969 | Ponsness | 86/25 |
| 3,702,089 | 11/1972 | Bachhuber | 86/32 |
| 3,771,411 | 11/1973 | Hazel | 86/25 X |
| 3,796,127 | 3/1974 | Deitemeyer | 86/25 X |
| 3,973,465 | 8/1976 | Bachhuber et al. | 86/45 |
| 4,020,737 | 5/1977 | Ranson | 86/23 |
| 4,031,804 | 6/1977 | Boschi | 86/23 |
| 4,078,472 | 3/1978 | Simpson | 86/23 |
| 4,163,410 | 8/1979 | Dillon | 86/36 |

*Primary Examiner*—Leland A. Sebastian
*Attorney, Agent, or Firm*—Quarles & Brady

[57] ABSTRACT

An apparatus for reloading spent ammunition shells includes a plurality of tools supported on a shaft above an elevatable carriage which define a plurality of reloading stations spaced circumferentially about the shaft, one of the stations having a priming tool and a power recharging tool, and a shell holder plate supported on the carriage for coincident vertical movement therewith and adapted for rotation about the shaft and to receive a plurality of separate spent ammunition shells and to position these shells simultaneously and sequentially in different reloading stations. The reloading apparatus also includes important new safety features which (1) prevent a freshly reprimed shell from being accidentally reprimed again and possible detonated; (2) isolate a new, live primer being inserted into a shell in the repriming operation from other live primers in an automatic primer feed mechanism; and (3) isolates the main source of powder from the delivery funnel in a powder feed mechanism during the powder recharging operation.

12 Claims, 13 Drawing Figures

Fig. 1
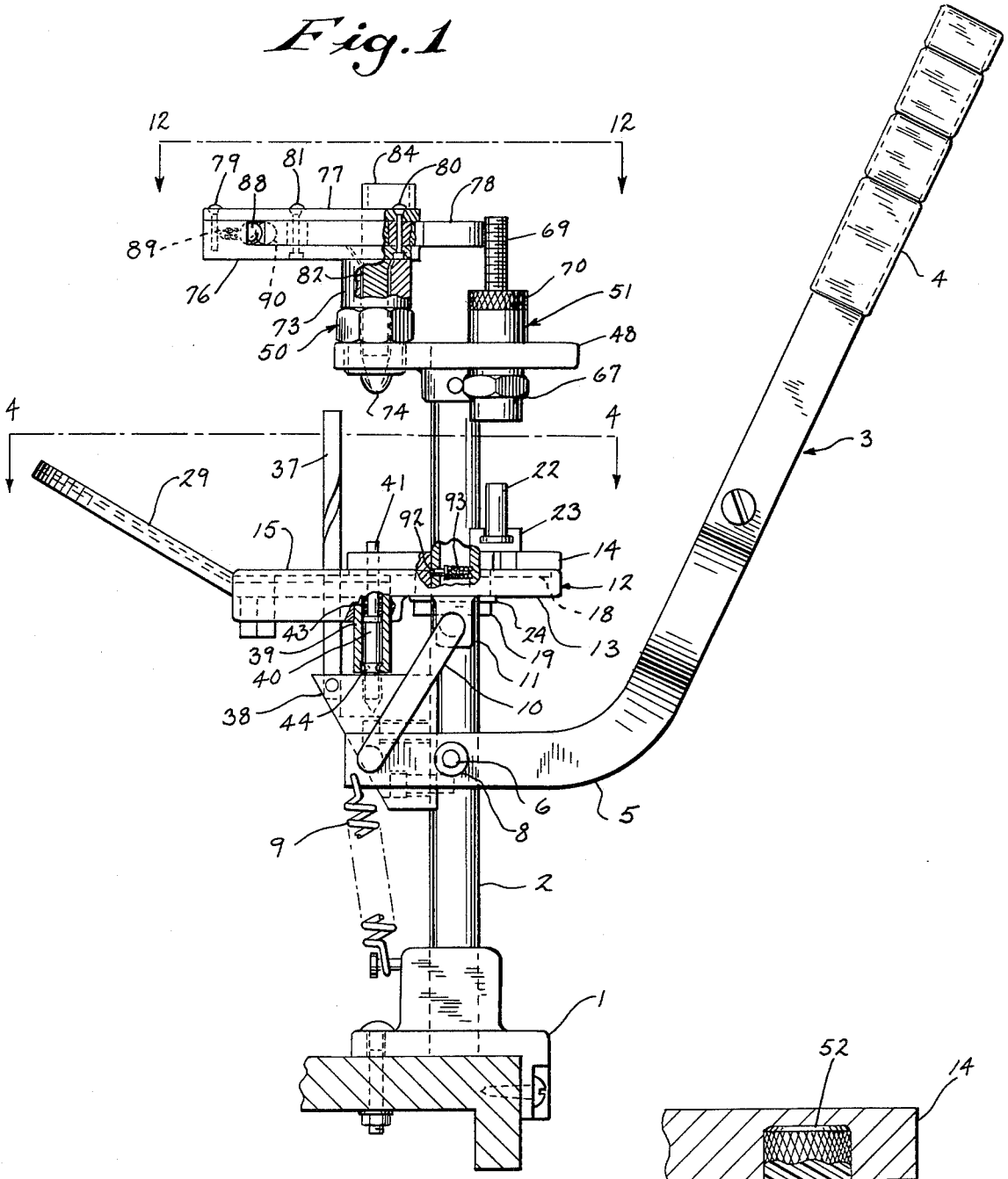
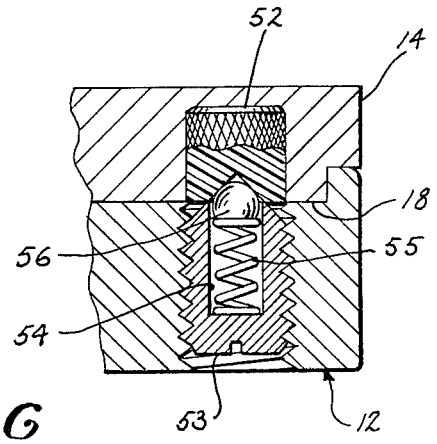
Fig. 6

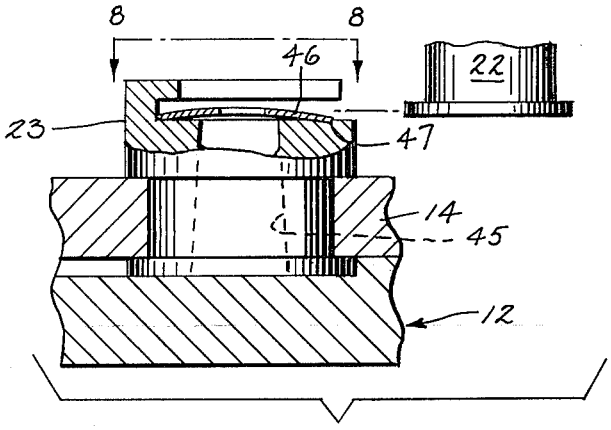
Fig. 7
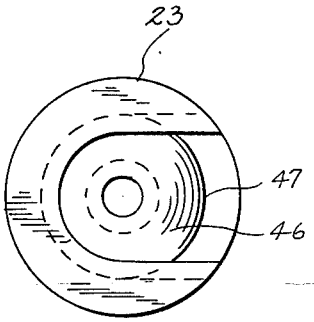
Fig. 8
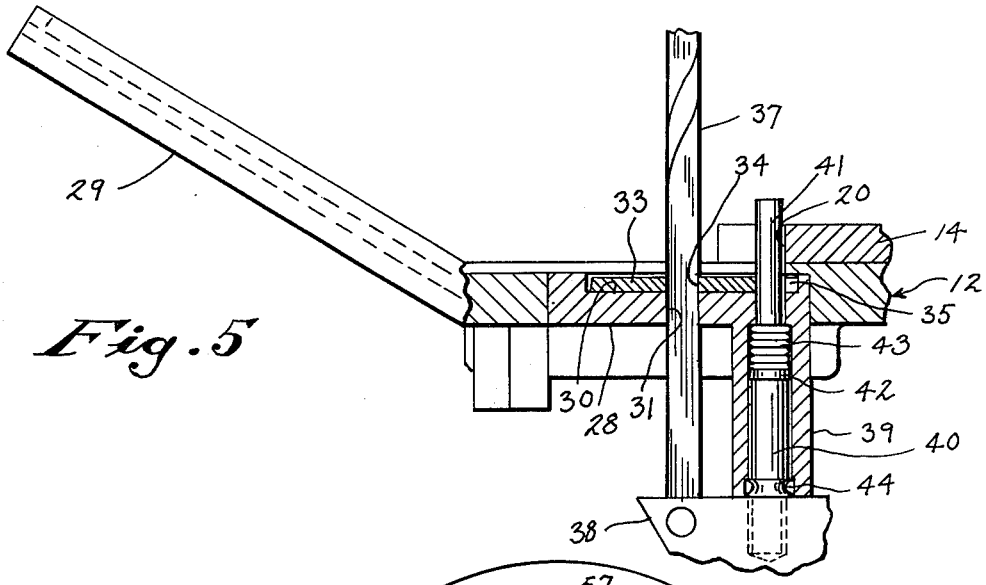
Fig. 5
Fig. 12
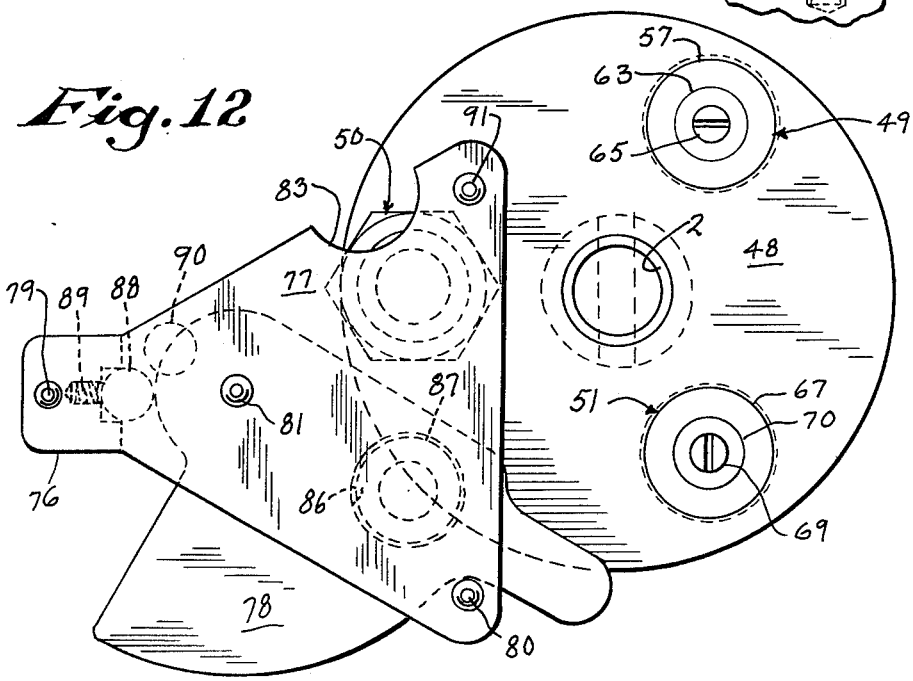

CARTRIDGE RELOADING PRESS

This invention relates to an apparatus for reloading spent ammunition shells and more particularly to a rifle and pistol cartridge reloading press having important new safety features.

BACKGROUND OF THE INVENTION

A reloading press for reloading spent rifle and pistol cartridges commonly includes tools for performing all or most of the individual steps of depriming, resizing, repriming, flaring the mouth of the cartridge, recharging the cartridge with powder, seating a new bullet in the cartridge and crimping the mouth of the cartridge about the bullet.

Reloading presses use a variety of tools for performing the reloading operations, and a variety of mechanisms for supplying new primers and powder to the cartridges. See, for example, U.S. Pat. No. 4,031,804 issued to Boschi which discloses an indexing mechanism for automatically rotating a shell support to reposition shot shells in subsequent operating stations after the completion of each reloading step, and U.S. Pat. No. 3,973,465 issued to Bachhuber et al which discloses an automatic primer feed mechanism. U.S. Pat. No. 3,336,829 issued to Lee, U.S. Pat. No. 3,242,790 issued to Bachhuber, and U.S. Pat. No. 3,796,127 issued to Deitemeyer also show various tools and mechanisms for performing the desired reloading operations.

U.S. Pat. No. 4,020,737 issued to Ranson for a "Cartridge Loading Machine" relates to a reloading press having a safety latch which prevents the actuation of a head carrying the tools for performing the reloading operations unless a shift plate has been manually actuated to advance the cartridges to the next reloading station. The safety latch is designed to protect a reprimed shell from being accidentally subjected to a second repriming operation which could detonate the primer.

SUMMARY OF THE INVENTION

The present invention relates to an improved reloading apparatus which includes a carriage supported on a shaft and movable up and down thereon, a plurality of tools supported on the shaft above the carriage which define a plurality of reloading stations spaced circumferentially about the shaft, one of the reloading stations having a priming tool and a powder recharging tool, and a shell holder plate supported by the carriage for coincident vertical movement therewith and adapted for rotation about the shaft and to receive a plurality of spent cartridges and to position such cartridges simultaneously in different reloading stations.

The reloading apparatus of the present invention may also include safety mechanisms which (1) prevent a freshly reprimed cartridge from being accidentally reprimed again and possibly detonated; (2) isolate a live primer being inserted into the cartridge during the repriming operation from other live primers; and (3) isolate the main source of powder from the delivery funnel in the powder recharging operation.

The safety mechanism which prevents the accidental second repriming of an already reprimed cartridge includes a stop mechanism having a retractible stop member mounted on the shaft and a means for retracting the stop member associated with the carriage. The stop member is retracted when the carriage is lowered and a cartridge is being freshly reprimed by the priming tool and is extended when the carriage is raised and the shell is being recharged by the powder tool so that the carriage cannot be accidentally lowered to bring the freshly reprimed cartridge into contact once again with the priming tool. The retracting means serves to retract the stop member when the shell holder plate and reprimed cartridge are rotated about the shaft and permits the carriage to be lowered again so that another shell supported by the carriage can be moved to the priming station and be reprimed.

In a preferred form, the reloading apparatus also includes an automatic primer feed mechanism for delivering, isolating and positioning a new primer at the priming station, and an improved powder feed mechanism for discharging only a predetermined amount of powder into the cartridge, and for isolating the discharge point from the main source of powder.

The preferred embodiment also includes a cartridge resizing tool which has a pair of resizing rings that greatly reduces the amount of applied force necessary during the resizing operation.

It is the general object of the invention to provide a reloading apparatus which is durable, economical to manufacture, safe and simple to operate.

It is another object of the invention to provide a reloading apparatus with an improved safety mechanism which prevents a freshly reprimed shell from being accidentally reprimed again and possibly detonated.

It is still another object of the invention to provide a reloading apparatus with an improved automatic primer feed mechanism which accurately and reliably delivers, positions and isolates a single new primer at the repriming station each time the repriming operation occurs.

It is yet another object of the invention to provide a reloading apparatus with an improved powder feed mechanism for accurately measuring and discharging an isolated predetermined amount of powder into a shell.

It is still a further object to provide a reloading device which greatly reduces the amount of force which must be applied during the resizing operation.

The foregoing and other objects and advantages of the invention will appear from the following description. In the description, reference is made to the accompanying drawings which form a part hereof, and in which there is shown by way of illustration and not of limitation, a preferred embodiment of the invention. Such embodiment does not represent the full scope of the invention, and reference is made to the claims herein for interpreting the breadth of the invention.

BRIEF DESCRIPTION OF THE DRAWINGS

FIG. 1 is a side view in elevation showing a cartridge reloading press constituting a preferred embodiment of the invention;

FIG. 5 is an enlarged fragmentary view partially in section of the assembled primer feed mechanism, priming tool and carriage for the reloading press of FIG. 1;

FIG. 6 is an enlarged fragmentary view in section of the indexing mechanism for a rotating plate of the carriage of the reloading press of FIG. 1;

FIG. 7 is an enlarged fragmentary view partially in section of a shell holder for the reloading press of FIG. 1;

FIG. 8 is a top view of a shell holder for the reloading press of FIG. 1 taken in the plane 8—8 indicated in FIG. 7;

FIG. 12 is a top view of the reloading press taken in the plane 12—12 indicated in FIG. 1.

DESCRIPTION OF THE PREFERRED EMBODIMENT

Figure 2:
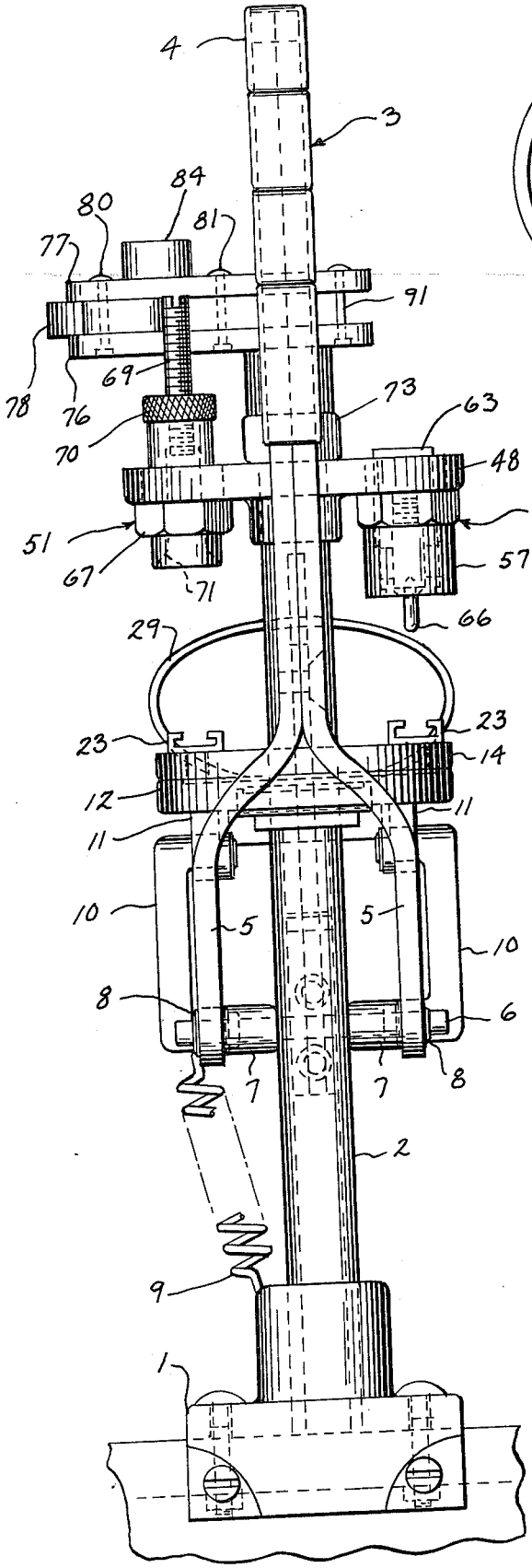
FIG. 2 is an end view of the cartridge reloading press taken from the right as shown in FIG. 1.

Referring to the drawings, FIGS. 1 and 2 show that the cartridge reloading press of the present invention includes a base 1 which can be bolted or secured to the edge of a table or other supporting surface. A hollow cylindrical shaft 2 is mounted in the base 1 and extends upwardly therefrom in a vertical manner. A hand lever 3 includes a grip portion 4 at its free end, and a pair of leg portions 5 at its other end which straddle either side of the shaft 2 and are pivotally mounted to the shaft 2 above the base 1. The pivotal connection of the hand lever 3 to the shaft 2 is provided by a pin 6 which extends through the shaft 2 and each of the leg portions 5. A pair of bushings 7 are interposed between the leg portions 5 and shaft 2 on the pin 6, as seen in FIG. 2, and a pair of push nuts 8 are used at both ends of the pin 6 to maintain the pin 6 in position. A spring 9 connects the end of one of the leg portions 5 to the base 1 so that the ends of the leg portions 5 are biased downwardly to normally hold the grip portion 4 of the hand lever 3 in an upward position. The ends of the leg portions 5 are pivotally attached to a pair of U-shaped links 10, and the links in turn are pivotally connected to a pair of ears 11 depending from a carriage 12. The carriage 12 is supported on the shaft 2 and is movable up and down thereon by means of its connection to the hand lever 3 through the links 10.

Figure 3:
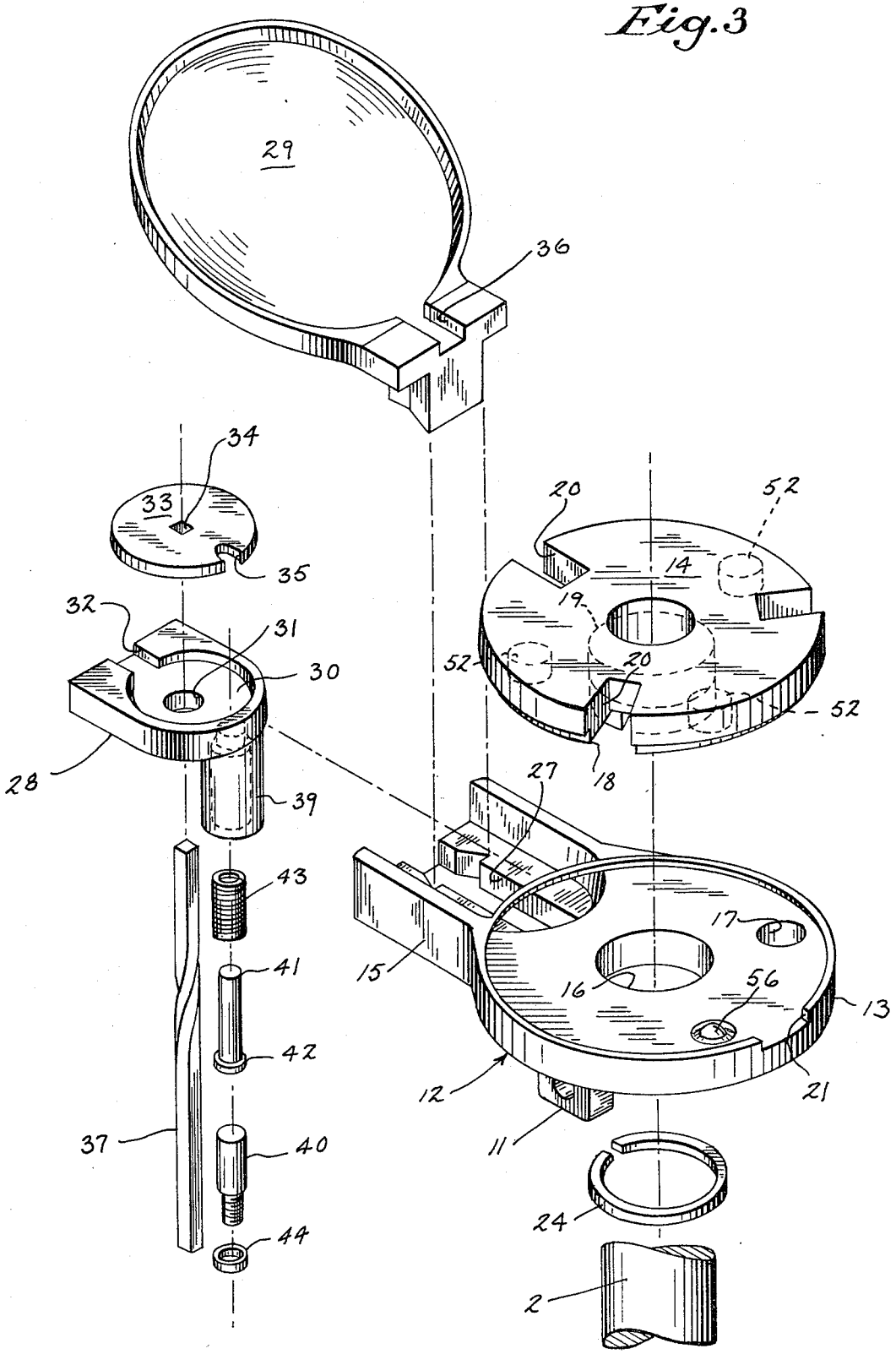
FIG. 3 is an exploded view in perspective showing the components of the primer feed mechanism, priming tool and carriage for the reloading press of FIG. 1.

As seen best in FIG. 3, the carriage 12 includes a disc portion 13 supporting a rotatable shell holder plate 14, and a channel-like portion 15 extending laterally from the disc portion 13 for supporting a primer feed mechanism, as will hereafter be described. The disc portion 13 includes a central recessed area and a rim formed along substantially its entire periphery. The disc portion 13 also includes a central opening 16, and a smaller opening 17 eccentrically located with respect to the central opening 16.

The shell holder plate 14 includes an annular shoulder portion 18 depending from its underside which is received within the recessed area of the carriage 12. As seen in FIG. 3, the plate 14 also includes a hollow skirt 19 depending from the underside of the shoulder portion 18 which extends through the central opening 16 of the carriage 12 and through which the shaft 2 extends. The shell holder plate 14 includes a series of three radial notches 20 formed equidistantly from each other along its periphery. It should be noted that the rim of the disc portion 13 of the carriage 12 is cut away, as at 21, and the shell holder plate 14 is adapted to be rotated about the shaft 2 so that when one of the notches 20 is located directly above and in line with the cut away portion 21 a loading station is defined which permits a shell 22 carried by a shell holder 23 to be inserted and held between the carriage 12 and plate 14. A groove is formed in the lower end on the skirt 19 which receives a snap ring 24 that holds the plate 14 in position.

Figure 4:
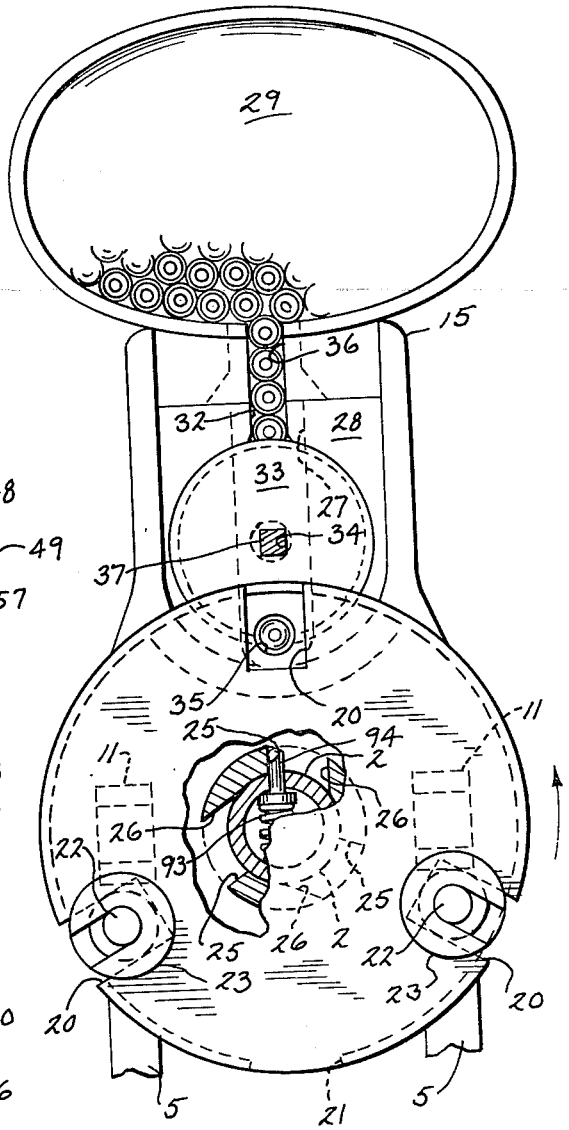
FIG. 4 is a top view of the primer feed mechanism, priming tool and carriage with parts broken away taken in the plane 4—4 indicated in FIG. 1.

As best seen in FIG. 4, the lower end of the skirt 19 is toothed and in the form of a ratchet-like wheel having a series of three abutment surfaces 25 and cam surfaces 26 formed along its periphery. The abutment surface 25 is formed along a radius line extending from the central axis of the main shaft 2, and the cam surface 26 is spaced from the abutment surface 25 and disposed in opposing relationship and parallel thereto along a line tangent to the inner circumference of the skirt 19. The purpose and operation of the surfaces 25 and 26 will hereinafter be more fully described.

The channel-shaped portion 15 of the carriage 12 is used to support the automatic primer feed mechanism and guide the priming tool for the reloading press. The channel-shaped portion 15 includes an elongate opening 27 in its web portion which is adapted to slidingly receive a primer disc holder 28 and a primer tray 29. As seen in FIGS. 3, 4 and 5, the primer disc holder 28 has a circular recessed area 30 with a central opening 31 formed therethrough and a primer feed passageway 32 communicating between the periphery of the holder 28 and the recessed area 30. A rotatable primer disc 33 is disposed in the recessed area 30, and includes a central square opening 34 which is in alignment with the central opening 31 of the primer disc holder 28. A notch 35 is formed in the periphery of the primer disc 33 which is adapted to receive a primer fed through the passageway 32 from the primer tray 29.

The primer tray 29 is mounted in the elongate opening 27 of the carriage 12 by means of a dovetail joint arrangement as shown best in FIG. 3. The primer tray 29 is dimensioned to hold a single layer of new primers and has a primer dispenser opening 36 at its periphery which is aligned with the primer feed passageway 32 of the holder 28. The primer tray 29 is angled upward and away from the dispenser opening 36 in order to gravity bias the primers toward the primer feed passageway 32 so that a single row of new primers may be fed through the passageway 32 to the primer disc 33. A square shaft 37 having a twist formed along its length extends through the aligned square opening 34 of the primer disc 33 and opening 31 of the primer disc holder 28. The shaft 37 is securely mounted at its lower end on a support plate 38 which in turn is bolted to the main shaft 2.

As seen best in FIGS. 3 and 5, the primer disc holder 28 includes a hollow cylindrical housing 39 depending from its underside. The housing 39 is adapted to receive a priming rod 40 and a priming pin 41. The priming rod 40 has its lower end threadedly engaged in the top of the support plate 38, and its upper end is adapted to extend into the housing 39. The priming pin 41 includes a rounded head portion 42 which is biased downwardly by a spring 43 which encircles the shank of the pin 41. A bushing 44 is press fit into the lower end of the housing 39 and is adapted to ride with the housing 39 and primer disc holder 28 when the carriage 12 is raised by actuation of the hand lever 3 to engage the head 42 of the pin 41 and hold the pin 41 within the housing 39, as will hereinafter be more fully understood.

Referring now to FIG. 7, it can be seen that each shell 22 is mounted within a shell holder 23 which in turn is received in the notches 20 of the shell holder plate 14, and held in position by having its lower end sandwiched between the underside of the shell holder plate 14 and the recessed area of the carriage 12. The shell holder 23 includes a through bore 45 which permits a spent primer to fall through the shell holder 23 during the depriming operation. The bore 45 also permits a new primer to pass through the shell holder 23 into the base of the shell 22 during the repriming operation. Each shell 22 is held in position in the shell holder 23 by means of an annular cup spring 46 having a central opening formed therein in alignment with the bore 45. The spring 46 is held within the shell holder 23 by means of a notch 47 cut into the face of the shell holder, as seen in FIG. 8. Thus, when the shell 22 is inserted into the shell holder 23 the base flange of the shell 22 will be forced up against the underside of the lip of the shell holer 23 by the cup spring 46 to securely hold the shell 23 in position.

As seen in FIGS. 1 and 2, a tool holder plate 48 is mounted on the main shaft 2 at its upper end. A plurality of tools, namely, a depriming and sizing tool 49, a flaring and powder tool 50, and a bullet seating and crimping tool 51, are mounted in the tool holder plate 48 and define a series of three operating stations. The tools 49, 50 and 51 which define the operating stations are spaced equally and circumferentially about the shaft 2.

FIGS. 2, 3 and 6 show a mechanism for indexing a series of three shells 22 held by the shell holder plate 14 so that the shells 22 may be positioned in the operating stations by being aligned with and held directly beneath the reloading tools 49, 50 and 51. The indexing means includes a set of three plugs 52 having a V-shaped notch formed therein which are equally spaced from one another and are press fit into the underside of the shell holder plate 12 near its periphery, and a threaded plug 53 engaged in an opening formed near the periphery of the disc portion 13 of the carriage 11. The threaded plug 53 has a bore 54 formed therein which receives a spring 55 and ball 56. The ball 56 is biased upwardly by the spring 53 so that as the plate 14 is rotated the ball 56 is forced against its underside until a notched plug 52 is moved over the plug 53. When this occurs, the ball 56 springs into the notch in the plug 52 so that the plate 14 is held firmly in position. The three notched plugs 52 are arranged circumferentially about the periphery of the plate 14 so that the radial notches 20 which hold the shells 22 in the plate 14 are stopped in three distinct positions as the plate 14 is rotated. These positions correspond to the operating stations defined by the tools 49, 50 and 51 so that the shells 22 are held directly beneath the tools 49, 50 and 51. In order to disengage the indexing means one must apply sufficient rotational force to the plate 14 to move the ball 56 back into the bore 54 of the plug 53 and permit further rotation of the plate 14.

Figure 9:
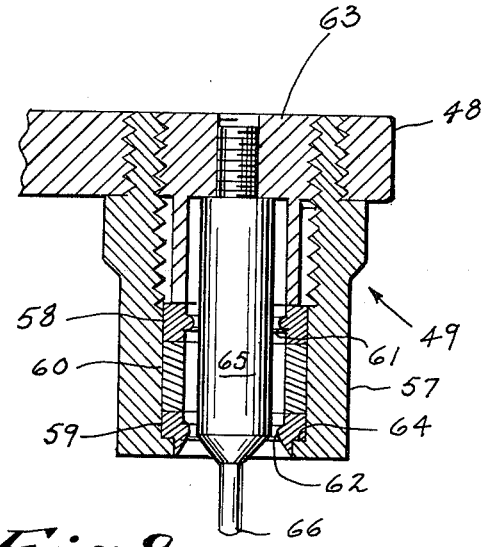
FIG. 9 is an enlarged fragmentary view partially in section of the depriming and resizing tool for the reloading press of FIG. 1.

Referring now to FIG. 9, the depriming and sizing tool 49 includes a hollow housing 57 threadedly engaged in the tool holder plate 48 which holds an annular upper sizing die 58 and an annular lower sizing die 59. The sizing dies 58 and 59 are separated by an annular spacer 60, and each die 58, 59 includes a sizing ring 61, 62, respectively, which projects from its inner surface. When a shell 22 is forced into the housing 57 the lower sizing ring 62 resizes the entire length of the cartridge and the upper sizing ring 61 resizes only the mouth portion of the cartridge. It has been found that the use of the sizing rings 61, 62 greatly reduces the amount of force necessary during the resizing operation. During substantially all of the resizing operation only the lower sizing ring 62 is in contact with the entire length of the cartridge and as a result the friction created between the sizing rings 61 and 62 and the wall of the cartridge is greatly reduced.

The lower sizing die 59 also includes a tapered opening, as shown in FIG. 9, which guides the mouth of the cartridge into the housing 57. The sizing dies 58 and 59 are held within the housing 57 by means of a retainer 63 which is threaded into the upper end of the housing 57 until its lower end engages the upper sizing die 58 and forces the upper die 58, spacer 60 and lower die 59 firmly together against a shoulder 64 formed along the bottom opening of the housing 57. A deprimer 65 having a decapper pin 66 is threadedly engaged in the retainer 63 so that its body extends through the aligned openings formed by the dies 58, 59 and spacer 60 and its pin 66 projects from the open bottom of the housing 57. The deprimer 65 may be adjusted by varying the depth it is turned into the retainer 63 so that its decapper pin 66 projects the desired distance from the lower end of the housing 57.

Figure 10:
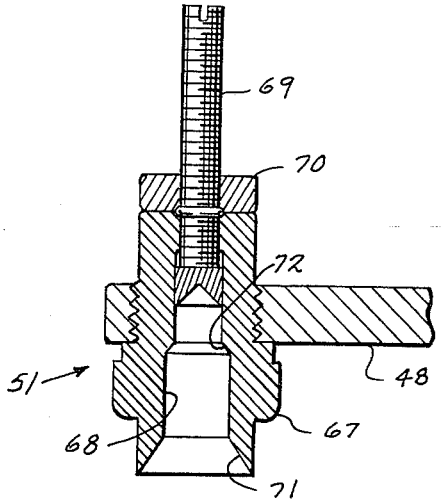
FIG. 10 is an enlarged fragmentary view partially in section of the bullet seating and crimping tool for the reloading press of FIG. 1.

Referring now to FIG. 10, the bullet seating and crimping tool 51 includes a hollow housing 67 threadedly engaged in the tool holder plate 48. The housing 67 includes a through bore 68 having a threaded upper end for engagement with a bullet seater 69. The bullet seater 69 has a V-shaped notch formed in its lower end, and may be turned down into the bore 68 to properly adjust its depth therein. After the bullet seater 69 is properly adjusted in the bore 68 of the housing 67 it may be locked in position by a lock nut 70 which prevents the bullet seater 69 from moving. When a shell 22 having a bullet placed in its mouth is forced into the bore 68, the notch in the lower end of the bullet seater 69 will engage the tip of the bullet and push the bullet the proper distance into the mouth of the shell 22. The lower end of the bore 68 includes a tapered portion 71 which guides the bullet and shell into the bore 68, and a shoulder 72 which crimps the mouth of the cartridge firmly against the side of the bullet so that the bullet is held tightly in the mouth of the cartridge.

Figure 11:
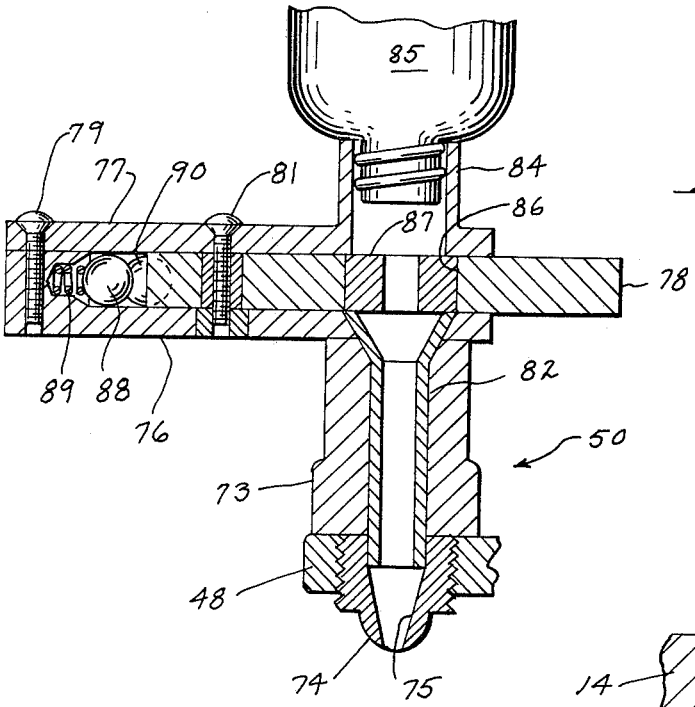
FIG. 11 is an enlarged fragmentary view partially in section of the flaring and powder recharging tool for the reloading press of FIG. 1.

Referring now to FIG. 11, the flaring and powder tool 50 includes a hollow housing 73 threadedly engaged at its lower end in the tool holder plate 48. The lower end of the housing 73 includes a spherical-like head 74 which flares the mouth of a cartridge forced upwardly against it. The housing 73 includes a dispensing bore 75 formed therethrough having a tapered upper portion which converges to a cylindrical middle portion which in turn leads to a cone-shaped lower portion. The bore 75 acts as a funnel for directing powder from a powder feed mechanism disposed above the tool holder plate 48 into an empty cartridge positioned beneath and in line with its lower portion.

As best seen in FIGS. 11 and 12, the powder feed mechanism includes a housing comprised of a lower plate 76 and an upper plate 77, and a pivotable charging bar 78 sandwiched between the plates 76 and 77 of the housing. The upper plate 77 is secured to the lower plate 76 by means of a pair of pins 79 and 80, and the pivotal connection of the charging bar 78 is provided by a third pin 81 which extends through the bar 78 and spans the distance between the upper plate 77 and lower plate 76. The lower plate 76 includes an opening in which the mouth of a funnel 82 is welded so that the lower end of the funnel 82 extends beneath the lower plate 76. As seen in FIG. 11, the funnel 82 is slidably received within bore 75 of the flaring and powder tool 50 so that the entire powder feed mechanism may be removed from the flaring and powder tool 50 as a unit.

The upper plate 77 includes a notch 83 formed in one of its sides, the purpose of which will hereinafter be described. The upper plate 77 also includes a cylinder 84 projecting from its upper surface which is adapted to engage the mouth of a bottle 85 filled with the desired powder.

As seen in FIG. 11, the charging bar 78 includes an opening 86 in which is disposed an annular bushing 87. The central open area of the bushing 87 is the powder-receiving chamber and is sized so that its volume is equivalent to the particular amount of powder necessary to recharge a particular cartridge. Different bushings 87 may be inserted in the opening 86, all having different central volumes depending upon the cartridge being reloaded and the desired amount of powder necessary to properly recharge the cartridge.

The charging bar 78 acts in a toggle-like manner to insure complete travel of its pivoting movements during a recharging operation. The toggle action is provided by a bearing 88 biased to the right, as seen in FIGS. 11 and 12, by a spring 89. The charging bar 78 includes a cam surface formed by a second bearing 90 secured along its back edge so that as the bar 78 is pivoted, either upwardly or downwardly as seen in FIG. 12, the cam surface of the bearing 90 engages the spring-biased bearing 88 until the center of the bearing 90 passes the center of the bearing 88 providing an over-center action which snaps the charging bar 78 into one or the other of its two positions. When the charging bar 78 is in the filling position shown in FIG. 12, the bushing 87 is disposed beneath the cylinder 84 and bottle 85 so that its central area can be filled with powder. The charging bar 78 may then be pivoted to its second, or dispensing, position in which the bushing 87 is disposed above the mouth of the funnel 82, at which time the powder contained within the bushing 87 drops down through the funnel 82 and into a cartridge 22. It should be noted that when the powder within the bushing 87 is disposed above the funnel 82 it is isolated from the main source of powder in the bottle 85. Thus, if a live primer in a shell 22 should for some reason detonate while the shell 22 is being recharged with powder, the force of the explosion is at a substantial distance from the powder bottle 85. This isolation of powder during a recharging operation is one of the safety features of the present invention.

It should also be noted that the toggle action of the charging bar 78 provides a means for agitating the bottle 85 to insure that the central area of the bushing 87 is completely filled with powder by snapping the bar 78 against the pin 80. The toggle action also provides a means for agitating the bushing 87 to insure that all of the powder contained within its central area drops into the funnel 82. When the bar 78 is pivoted upwardly as seen in FIG. 12, it will snap against a fourth pin 91 which will agitate the powder causing it to drop into the funnel 82. The pin 91 is removable so that if it is desired to change the bushing 87 all that is necessary is to remove the pin 91 and move the charging bar 78 so that the bushing 87 is beneath the notch 83 in the upper plate 77. The bushing 87 may then be removed and replaced. Once a new bushing 87 has been replaced in the charging bar 78, the bar 78 is pivoted to its position beneath the powder bottle 85 and the pin 91 is replaced.

Figure 13:
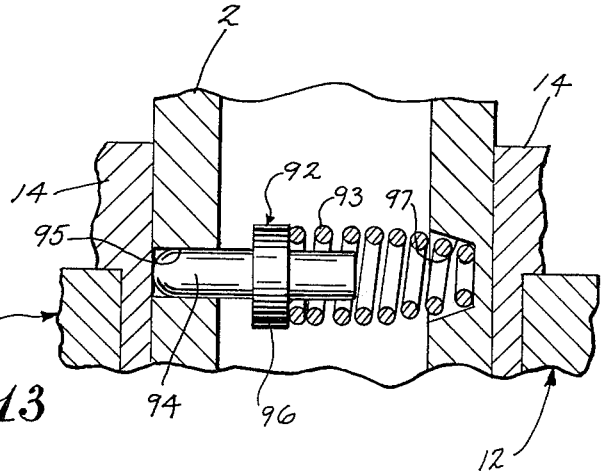
FIG. 13 is an enlarged fragmentary view partially in section of a stop member mounted within the shaft of the reloading press of FIG. 1.

Referring now to FIGS. 1, 4 and 13, it can be seen that a safety mechanism is disposed within the shaft 2 of the cartridge reloading press of the present invention. The safety mechanism includes a pin or stop member 92 extending transversely of the longitudinal axis of the shaft 2, and a coil spring 93 for biasing the stop member 92 to the left, as seen in FIG. 13. The stop member 92 includes a forward end 94 slidably disposed within an opening 95 formed in the wall of the shaft 2, and a projecting flange 96 formed near its rearward end. The spring 93 is seated at one end against the flange 96 of the stop member 92, and at its other end within a bore 97 formed in the interior of the wall of the shaft 2 directly opposite or coaxial with the wall opening 95. The operation of the stop member 92 and cartridge reloading press of the present invention will now be described.

OPERATION

In operation of the cartridge reloading press, the carriage 12 is in its lowered position at the commencement of the operation, as shown in FIG. 1. The shell holder plate 14 is then rotated counterclockwise, as shown by the arrow in FIG. 4, until one of its notches 20 is aligned with the cut away portion 21 of the rim of the carriage 12. The aligned notch 20 and cut away portion 21 define a loading station, and after an empty cartridge shell 22 is slid into a shell holder 23, the shell 22 and its holder 23 are inserted into the loading station and the shell holder plate 14 is rotated to the first reloading station which is located beneath the depriming and sizing tool 49.

The hand lever 3 may then be pivoted downwardly so that the carriage 12, shell holder plate 14, and shell 22 are moved upwardly along the shaft 2 until the shell 22 engages the housing 57 of the depriming and sizing tool 49. Further downward movement of the hand lever 3 forces the shell 22 into the interior of the housing 57 so that the upper sizing ring 61 of the upper sizing die 58 and the lower sizing ring 62 of the lower sizing die 59 may reform and resize the entire length of the used cartridge shell. The stroke length off the hand lever 3 and carriage 12 and the position of the tool 49 in the tool holder plate 48 are correlated so that the empty cartridge shell 22 is forceably inserted exactly the desired distance into the housing 57 of the depriming and sizing tool 49. This is particularly important so that the empty shell 22 may be accurately resized and reshaped in order to rechamber in a gun.

As the shell 22 enters the housing 57 of the depriming and sizing tool 49, the deprimer 65 extends downwardly into the interior of the shell 22, and as the shell continues upwardly the decapper pin 66 engages and pushes the spent primer out through the bottom opening of the shell 22 and through the bore 45 of the shell holder 23. The spent primer then falls through the small opening 17 in the carriage 12. Thus, the first reloading station simultaneously resizes and reprimes an empty shell upon the downward stroke of the hand lever 3 and the corresponding upward movement of the carriage 12 and shell holder plate 14.

After the shell 22 has been deprimed and resized, the stop member 92 of the reloading press becomes operational. As the carriage 12 is raised on the shaft 2, the stop member 92 moves from its retracted position within the shaft 2, as shown in FIGS. 1 and 13, to its extended position wherein the forward end 94 of the stop member 92 extends radially outwardly from the shaft 2, as shown in FIG. 4. The stop member 92 is mounted along the shaft 2 so that as the operator moves the hand lever 3 upwardly and the carriage 12 begins its downward travel along the shaft 2, the shell 22 is permitted to clear the lower end of the housing 57 of the depriming and sizing tool 49 before the pin 92 engages the lower end of the skirt 19 and prevents any further downward movement of the carriage 12. As can be seen in FIG. 4, when the pin 92 is in its extended position the abutment surface 25 formed in the skirt 19 of the shell holder plate 14 prevents the plate 14 from being rotated in a clockwise direction. This prevents the operator from rotating the shell 22 in the wrong direction. The cam surface 26, however, permits the shell holder plate 14 to be rotated counterclockwise and forces the pin 92 once again into its retracted position within the shaft 2. Thus, the pin 92 and surfaces 25 and 26 cooperate with each other to form a ratchet mechanism. As the plate 14 is rotated in a counterclockwise direction, a second notch 20 of the shell holder plate 14 becomes aligned with the cut away portion 21 of the rim 12 which permits a second shell and shell holder to be inserted into the plate 14. Further counterclockwise rotation of the plate 14 results in the first shell being moved to the second reloading station, which is beneath the flaring and powder tool and above the priming tool, and the second shell being moved to the first reloading station.

When the carriage 12 is in its uppermost position the notch 35 in the primer disc 33 faces the primer feed passageway 32 and receives a new primer from the tray 29. As the carriage 12 begins its downward travel along the shaft 2, the twist in the stationary square shaft 37 causes the primer disc 33 to be rotated 180 degrees in a counterclockwise direction, as seen in FIG. 4, so that the new primer is positioned directly above the priming pin 41. After the shell holder plate 14 is rotated and the stop member 92 is retracted, as described above, and the carriage 12 is permitted to complete its downward travel, the base of the priming pin 41 engages the priming rod 40 and the base of the first shell engages the new primer. Continued downward movement of the carriage 12 forces the new primer into the receiving opening in the base of the descending shell. It should be noted that the priming operation takes place at a spaced distance from the remaining primers located in the primer tray 29 and the primer feed passageway 32 due to the 180 degrees rotation of the primer disc 33. Thus, a new primer being inserted into a shell during the repriming operation is isolated from the remaining live primers so that if for some reason the new primer detonates, the force of its explosion is at a substantial distance from the live primers. The isolation of the new primer during a repriming operation is one of the safety features of the present invention.

The downward travel of the carriage 12 and the height of the priming pin 41 are correlated so that a new primer is forceably inserted exactly the desired distance into the empty shell. The result is that as the carriage 12 reaches the bottom of its downward travel a new primer has been fully inserted into the used shell. Thus, with one complete downward and upward stroke of the hand lever 3, a used shell has been deprimed, resized and reprimed.

As the operator begins the second downward stroke of the hand lever 3, the carriage 12 moves upwardly along the shaft 2 so that the second shell, which is now in the first reloading station, is also moved upwardly until its mouth engages the flaring and powder tool 50. It should be noted that when the carriage 12 travels upwardly along the shaft 2 the twist in the square shaft 37 causes the primer disc 33 to be once again rotated 180 degrees in a counterclockwise direction, so that its notch 35 is once again facing the primer feed passageway 32 to receive a new primer from the primer tray 29. When the mouth of the first shell 22 is forced against the spherical head 74 of the flaring and powder tool 50 it is flared radially outwardly in order to facilitate the insertion of a new bullet, as will hereinafter be described.

While in this upper position, the first shell 22 is also refilled with a new charge of powder by the powder feed mechanism. As shown in FIG. 12, the charging bar 78 is initially positioned beneath the powder bottle 85 so that its bushing 87 is filled with recharging powder. The charging bar 78 is then pivoted so that the bushing 87 is positioned above the funnel 82. When the charging bar 78 is pivoted its toggle action causes it to be snapped against the pin 91, which jars the bushing 87 and assures that all of the powder contained within the bushing 87 drops through the funnel 82 and into the empty shell 22. The charging bar 78 is then pivoted back to its initial toggle action against the pin 80, which jars the bottle 85 to assure that the bushing 87 is once again completely filled with powder.

Once the first shell 22 has been recharged with powder, and the second shell has been deprimed and resized, the hand lever 3 may once again begin its upward stroke so as to permit the carriage 12 to be lowered on the shaft 2. It should be noted, however, that the stop member 92 has once again moved to its extended position because of the upward travel of the carriage 12. As a result, as the carriage 12 moves downwardly on the shaft 2, the freshly primed first shell 22 cannot be accidentally lowered a sufficient amount to bring its live primer into contact once again with the priming tool. It can thus be seen that the stop member 92 is another safety feature of the present invention. The stop member 92 prevents a freshly reprimed and recharged shell from being accidentally reprimed again and possibly detonated. As a result, the shell holder plate 14 must once again be rotated in a counterclockwise direction so that the stop member 92 is retracted by the cam surface 26 of the ratchet-like end of the skirt 19 in order to permit completion of the upward stroke of the hand lever 3. As the plate 14 is rotated, a third shell 22 and shell holder 23 may be inserted at the loading station. Upon further rotation of the plate 14, the first shell 22 becomes located at the third reloading station, which is beneath the bullet seating and crimping tool 51, the second shell 22 becomes located at the second reloading station beneath the flaring and powder tool 50, and the third shell 22 becomes located at the first reloading station beneath the repriming and resizing tool 49. The upward stroke of the hand lever 3 and the corresponding downward travel of the carriage 12 may then be completed. As a result, the second shell 22 is reprimed by the priming tool as previously described. Thus, after two complete strokes of the hand lever 3 the first shell has been deprimed, resized, reprimed, flared and recharged with powder, the second shell has been deprimed, resized, and reprimed, and the third shell has not yet been operated upon.

Before the operator moves the hand lever 3 downwardly to begin its third stroke, a new bullet is inserted into the mouth of the first shell 22, which is facilitated by its flared condition. When the hand lever 3 is moved downwardly, the second shell 22 is flared and recharged with powder as described above, and the third shell 22 is deprimed and resized, as described above. The third shell 22, however, which is now in the third reloading station, is moved upwardly to engage the bullet seating and crimping tool 51. As the bullet and shell 22 are forced into the bore 68 of the housing 67 of the bullet seating and crimping tool 51, the lower end of the bullet seater 69 engages the tip of the bullet and forces it into the shell 22. The upward travel of the carriage 12 and the depth of the bullet seater 69 are properly adjusted and are correlated so that the bullet is forceably inserted exactly the desired distance into the shell 22. At substantially the same time, the shoulder 72 formed in the bore 68 of the bullet seating and crimping tool 51 forces the mouth of the shell 22 to be crimped about the bullet to securely hold the bullet at its proper depth in the shell 22.

Upon completion of the above steps, the hand lever 3 is once again moved upwardly and the carriage 12 is correspondingly moved downwardly along the shaft 2. However, the stop member 92 has once again moved to its extended position so that the carriage 12 cannot be lowered to its initial starting position, and the freshly reprimed second shell 22 cannot be lowered into contact with a live primer. As a result, the plate 14 must once again be rotated in a counterclockwise direction so that the stop member 92 is retracted by the cam surface 26 of the ratchet-like end of the skirt 19. However, as the first shell 22, which is now a completely reloaded shell, becomes positioned at the reloading station it may be removed and fourth shell 22 and shell holder 23 may be inserted in its place. The plate 14 may then be further rotated so that the fourth shell is in the first reloading station, the third shell is in the second reloading station, and the second shell is in the third reloading station. The hand lever 3 may then be raised, and the carriage 12 lowered, to reprime the third shell 22. The above-described operations are then repeated for each succeeding empty shell until the desired number of shells have been reloaded.

A hand operated press for reloading spent ammunition shells has been described which positions a plurality of separate shells sequentially in a series of operating stations where different reloading operations are carried out simultaneously on the shells. Several safety features are incorporated in the reloading press. One safety feature is in the form of a retractible stop member 92 mounted on a shaft 2 that prevents a freshly reprimed shell from being accidentally reprimed again and possibly detonated. The stop member 92 cooperates in a ratchet-like manner with an abutment surface 25 and a cam surface 26 formed in the lower end of a skirt 19 which is integrally attached to a shell holder plate 14 carried by a carriage 11 that supports the shells during the reloading operations. The loading press has a resizing tool 49 with upper and lower resizing rings 61 and 62 which reduce the friction between the resizing dies 58 and 59 and a shell 22 so that the force necessary to resize the shell is greatly reduced. As another safety feature, the reloading press also includes a powder feed mechanism which includes a pivotable charging bar 78 that isolates the main source of power from that being used to recharge a shell during the powder recharging operation. The charging bar 78 also operates in a toggle-like manner for jarring or agitating a powder bottle 85 when it is pivoted in one direction to insure that the appropriate amount of powder is discharged into a bushing 87 carried by the charging bar 78, and when it is pivoted in its other direction to insure that all the powder carried by the bushing 87 is discharged into a funnel 82 which leads to an empty cartridge. The reloading press also includes an improved primer feed mechanism which provides a means for automatically delivering a single new primer accurately into position to reprime a shell. The primer feed mechanism provides yet another safety feature for the reloading press by positioning the main source of new primers at a spaced distance from the repriming position so that if a primer should accidentally detonate during the repriming operation the point of detonation is located at a position which is removed from the main source of primers.

I claim:

1. An apparatus for reloading spent ammunition shells having a base, a shaft mounted on said base which extends upwardly therefrom, a carriage supported on said shaft and movable up and down thereon, a means for moving said carriage up and down on said shaft relative to said base, a plurality of tools supported on said shaft defining a plurality of reloading stations spaced circumferentially about the shaft, one of said reloading stations being a repriming station having a priming tool, and a shell holder plate supported by the carriage for coincident vertical movement therewith and for manual rotation about the shaft, said plate adapted to receive a plurality of separate spent ammunition shells and to position such shells simultaneously and sequentially in different reloading stations.

2. The apparatus of claim 1 which includes a stop means for preventing the carriage from being accidentally lowered to bring a freshly reprimed shell back into contact with the priming tool.

3. The apparatus of claim 2 wherein said stop means includes:

(a) a retractible stop member mounted on said shaft, said stop member being retracted when said carriage is lowered and a shell is being freshly reprimed by the priming tool and extended when the carriage is raised so that the carriage cannot accidentally be lowered again to bring the freshly reprimed shell into contact with the priming tool; and (b) a toothed ratchet-like member associated with the shell holder plate which serves to retract the stop member as the plate and freshly reprimed shell are rotated about the shaft to permit the carriage to be lowered again and another shell supported by the carriage to be moved to the priming station and to be reprimed.

4. The apparatus of claim 3 wherein said stop member includes:

a pin member slidably disposed within said shaft having a forward end adapted to extend radially through an opening in said shaft; and spring means disposed within said shaft for biasing said pin member toward said opening.

5. The apparatus of claim 3, wherein said toothed ratchet-like member includes:

an abutment surface which cooperates with said stop member to prevent rotation of said shell holder plate in one direction; and a cam surface spaced from said abutment surface and disposed in opposing relationship thereto which cooperates with said stop member to permit rotation of said shell holder plate in its other direction and to move said stop member to its retracted position and allow further downward movement of said carriage to reprime another shell.

6. The apparatus of claim 1, wherein one of said reloading stations is a resizing station having a resizing tool which includes a hollow housing and an annular sizing die disposed within said housing having a sizing ring projecting inwardly therefrom for engagement with a cartridge forcibly inserted within said sizing die.

7. An apparatus for reloading spent ammunition shells having a base, a shaft mounted on said base which extends upwardly therefrom, a carriage supported on said shaft and movable up and down thereon, a means for moving said carriage up and down on said shaft relative to said base, a plurality of tools supported on said shaft defining a plurality of reloading stations spaced circumferentially about the shaft, one of said reloading stations being a powder recharging station, having a powder recharging tool that includes a dispensing opening formed therein, a shell holder plate supported by the carriage for coincident vertical movement therewith and for rotation about the shaft, said plate adapted to receive a plurality of separate spent ammunition shells and to position such shells simultaneously and sequentially in different reloading stations, and a means for feeding powder to the powder recharging tool which includes a housing detachably mounted on said recharging tool, and a two-position toggle member having a powder-receiving chamber of predetermined volume pivotally mounted on said housing through a dead-center position on one side of which it snaps to a powder filling position for said chamber and on the other side of which it snaps to a powder dispensing position for said chamber which is isolated from a main source of powder and is in register with the dispensing opening of said recharging tool.

8. The apparatus of claim 7 wherein said means for feeding powder to the powder recharging tool further includes bearing means resiliently mounted in said housing, and said toggle member has a cam surface thereon for engaging the surface of said bearing means as it is pivoted between said filling and dispensing positions.

9. The apparatus of claim 7 wherein said powder recharging tool includes a spherical head for flaring the mouth of an empty cartridge forced against said head.

10. The apparatus of claim 7 wherein said toggle member includes a removable annular bushing and said powder-receiving chamber is the central open area of said bushing.

11. An apparatus for reloading spent ammunition shells having a base, a main shaft mounted on said base which extends upwardly therefrom, a carriage supported on said shaft and movable up and down thereon, a means for moving said carriage up and down on said shaft relative to said base, a plurality of tools supported on said shaft defining a plurality of reloading stations being a repriming station having a priming tool that includes a priming pin, shell holder plate supported by the carriage for coincident vertical movement therewith and for rotation about the shaft, said plate adapted to receive a plurality of separate spent ammunition shells and to position such shells simultaneously and sequentially in different reloading stations, and means for delivering a primer to said priming tool which includes a primer tray mounted on said carriage having a dispenser opening formed therein, a rotatable primer disc mounted on said carriage between said primer tray and said repriming station and having a primer-receiving opening formed in its periphery, and means for rotating said primer disc so that said opening receives a primer from said dispenser opening when said carriage is raised and rotates to position and isolate the primer at said repriming station when said carriage is lowered.

12. The apparatus of claim 11, wherein said primer disc includes a central square opening, and said means for rotating said primer disc includes a stationary square shaft which extends through said central square opening and is mounted on said main shaft, said square shaft having a twist formed along its length so that when said carriage and primer disc are raised the primer-receiving opening faces said dispenser opening to receive a primer and when said carriage and primer disc are lowered the primer-receiving opening rotates 180 degrees to position said primer at said repriming station.

* * * * *